US008180614B2

(12) United States Patent
Pabon et al.

(10) Patent No.: US 8,180,614 B2
(45) Date of Patent: May 15, 2012

(54) MODELING VIBRATION EFFECTS INTRODUCED BY MUD MOTOR

(75) Inventors: Jahir A. Pabon, Newton, MA (US); Yong Chang, Missouri City, TX (US); Nathaniel Wicks, Somerville, MA (US); Richard Harmer, Cheam (GB); Yingyu Fang, Moorhead, MN (US); Xiaoyan Shi, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 688 days.

(21) Appl. No.: 12/346,935

(22) Filed: Dec. 31, 2008

(65) Prior Publication Data

US 2010/0163306 A1 Jul. 1, 2010

(51) Int. Cl.
*G06F 9/455* (2006.01)

(52) U.S. Cl. ..... 703/10; 703/7

(58) Field of Classification Search ..... 703/7, 10, 703/1, 2; 175/24, 40, 61, 171, 431, 369, 175/327; 702/9, 29, 34; 73/650, 862.08, 73/460, 562, 460.562; 318/617, 623, 432; 310/51; 8/147; 384/107; 416/198 A, 95; 192/48.8

See application file for complete search history.

(56) References Cited

U.S. PATENT DOCUMENTS

| | | | | |
|---|---|---|---|---|
| 4,057,714 | A * | 11/1977 | Fork et al. | 702/34 |
| 4,282,756 | A * | 8/1981 | Molnar et al. | 73/650 |
| 4,805,457 | A * | 2/1989 | Oates et al. | 73/572 |
| 4,984,173 | A * | 1/1991 | Imam et al. | 700/279 |
| 5,321,981 | A | 6/1994 | Macpherson | |
| 5,452,616 | A * | 9/1995 | Leon et al. | 73/862.08 |
| 5,729,111 | A * | 3/1998 | Ogura et al. | 318/623 |
| 2004/0245959 | A1 * | 12/2004 | Komiya | 318/607 |
| 2005/0133272 | A1 * | 6/2005 | Huang et al. | 175/327 |
| 2005/0188765 | A1 * | 9/2005 | Care et al. | 73/460 |
| 2005/0279532 | A1 * | 12/2005 | Ballantyne et al. | 175/40 |
| 2006/0021797 | A1 * | 2/2006 | Krueger | 175/61 |
| 2006/0113113 | A1 * | 6/2006 | Underwood et al. | 175/61 |
| 2006/0133705 | A1 * | 6/2006 | Nakamiya et al. | 384/107 |
| 2006/0180356 | A1 * | 8/2006 | Durairajan et al. | 175/431 |
| 2006/0212224 | A1 * | 9/2006 | Jogi et al. | 702/9 |
| 2006/0225984 | A1 * | 10/2006 | Tanishima et al. | 192/48.8 |
| 2007/0006393 | A1 * | 1/2007 | Ishida et al. | 8/147 |
| 2007/0119626 | A9 * | 5/2007 | Giroux et al. | 175/61 |
| 2007/0181345 | A1 * | 8/2007 | Vail | 175/171 |
| 2007/0192071 | A1 | 8/2007 | Huang et al. | |
| 2008/0255817 | A1 | 10/2008 | Pabon et al. | |

(Continued)

FOREIGN PATENT DOCUMENTS

GB 2467626 B 12/2009

OTHER PUBLICATIONS

Tse et al., "Mechanical vibrations", Prentice-Hall of India Private Limited, 1968.*

*Primary Examiner* — Kandasamy Thangavelu
(74) *Attorney, Agent, or Firm* — Jianguang Du; Hoffman Warnick LLC

(57) ABSTRACT

Torsional, axial and lateral vibrations introduced when a mud motor is used with a drilling tool to drill a borehole are calculated using a model. The model includes different computational modules for each of three distinct motor sections: power, transmission and bearing. The resulting calculated vibration effects are used to enhance the drilling tool and drilling operation.

21 Claims, 11 Drawing Sheets

U.S. PATENT DOCUMENTS

2008/0315691 A1* 12/2008 Jeung ..... 310/51
2009/0030658 A1* 1/2009 Durairajan et al. ..... 703/1
2009/0044977 A1* 2/2009 Johnson et al. ..... 175/24
2009/0320609 A1* 12/2009 Xia et al. ..... 73/862.08
2010/0092293 A1* 4/2010 Benkler et al. ..... 416/95
2010/0139987 A1* 6/2010 Hunt et al. ..... 175/369
2010/0141193 A1* 6/2010 Rotondo et al. ..... 318/432
2010/0166559 A1* 7/2010 Ahaus et al. ..... 416/198 A

* cited by examiner

MODELING VIBRATION EFFECTS INTRODUCED BY MUD MOTOR

FIELD OF THE INVENTION

This invention is generally related to drilling boreholes in subterranean formations, and more particularly to modeling vibration effects introduced by mud motors in order to enhance planning and operation.

BACKGROUND OF THE INVENTION

Mud motors are well known for use in drilling operations. The motors can be used to locally convey power to a drill bit, such as described in GB2059481 A, GB2428212 A, and others. Mud motors can also be used to steer the bit in a desired drilling direction, such as described in WO2000037764, EP85444 A2, GB2433082 A, and to increase the rotational speed of the bit in rotary steerable systems. However, the use of a mud motor in a drill tool can cause significant and complex changes to the dynamic behavior of the tool.

In order to enhance drilling operations it is known to develop a drilling plan before drilling operations begin. Adjustments are later made to the plan based on results obtained during drilling operations. In order to develop an effective drilling plan and make appropriate adjustments in the field it is useful to have an understanding of both the formation and how a particular drilling tool operates in that formation. It is well known to use computerized modeling to simulate the operation of a particular drilling assembly for a particular formation and drilling operation. By analyzing the results of such a simulation, the drilling operation and the drilling assembly may be modified to help achieve the goals of the drilling operation. For example, results of the simulation can be analyzed to estimate vibration, efficiency, wear and other properties.

A considerable body of work has been developed around calculating the dynamic behavior of a drilling tool while drilling a borehole. However, relatively little work has been done on modeling the specific effects caused by the use of a mud motor. Moran et al, US20070185696 A1, models the kinematic aspect of the incremental rotation speed below the motor. However, there is no treatment of transient aspects of the torques and forces being transmitted between the stator and rotor. *Stick-Slip and Bit-Bounce of Deep-Hole Drillstrings*, A. Baumgart, Transactions of the ASME, pp. 78-82, Vol. 122, June 2000, uses a lump parameter model of the motor. However, the model neglects lateral vibrations. Further, the design of mud motors typically inhibits transmission of higher frequency vibration components upward though the drillstring, so reliance on vibration data captured above the mud motor is problematic. While it is at least theoretically possible to obtain an accurate prediction of mud motor behavior using highly complex multi-physics numerical methods such as finite elements with fluid-structure interaction, obtaining a solution at a particular instant in time can be prohibitively expensive and obtaining solutions for thousands of different configurations of the motor as required by a time transient simulation of the drill string becomes impractical.

SUMMARY OF THE INVENTION

The present invention is predicated in part on recognition that several factors are primary contributors to the vibration effects introduced by a mud motor. For example, coupled dynamics relating to changes in mud pressure, mud flow, torque and relative motor RPM are primary contributing factors. Another primary contributing factor is the lateral vibrations that occur as a result of the whirling of the rotor axis around the stator (nutation), which is inherent to the typical mud motor design. Another primary contributing factor is the effect on transmission/reflection of axial and torsional vibrations along the tool caused by the partially free end condition at the top of the rotor. Further, the inventors have recognized that the mud motor may be modeled as a plurality of discreet components which have different contributions to the factors listed above. For example, a model allows evaluation of the operational environment present below a mud motor, in the case where equipment is run below the motor, between the motor and drill bit.

In accordance with an embodiment of the invention, a method for modeling vibration introduced to a drilling tool by a mud motor comprises: separately computing at least one vibration effect for each one of a plurality of sections of the mud motor; computing interactions between ones of the sections to produce modeled vibration effects; and controlling an aspect of drilling based at least in part on the modeled vibration effects.

In accordance with another embodiment of the invention, an apparatus for enhancing drilling with a drilling tool, comprises: a mud motor; at least one sensor that collects raw vibration data proximate to the mud motor; a device that operates in response to the vibration data from the at least one sensor to separately compute at least one vibration effect for the each one of a plurality of sections of the mud motor, compute interactions between ones of the sections to produce modeled vibration effects, and control an aspect of drilling based at least in part on the modeled vibration effects.

In accordance with another embodiment of the invention, a computer program product, comprises a computer usable medium having a computer readable program code embodied therein, said computer readable program code adapted to be executed to implement a method for modeling vibration effects introduced to a drilling tool by a mud motor, said method comprising: separately computing at least one vibration effect for each one of a plurality of sections of the mud motor; computing interactions between ones of the sections to produce modeled vibration effects; and controlling an aspect of drilling based at least in part on the modeled vibration effects.

DETAILED DESCRIPTION

Figure 1:
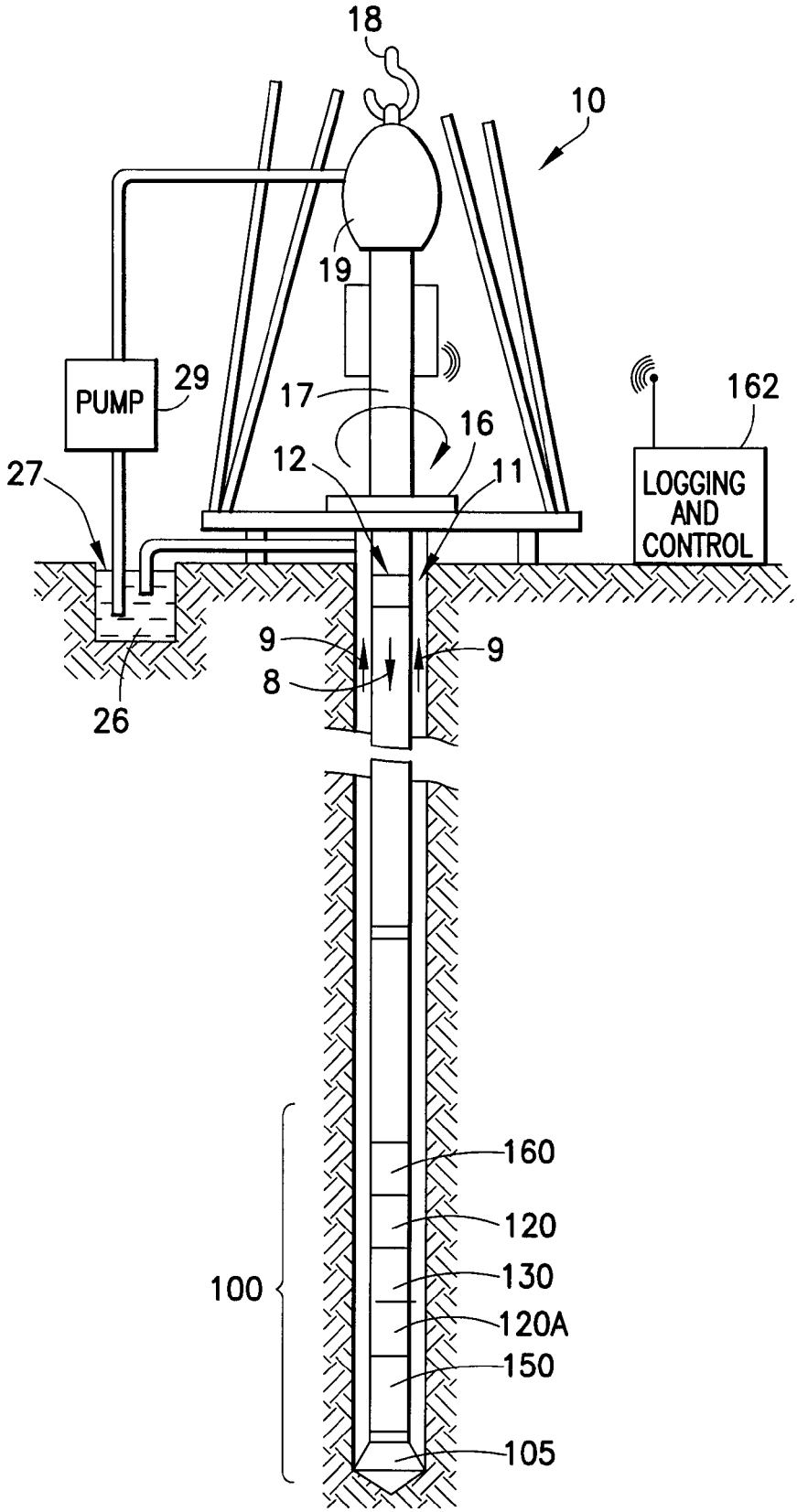
FIG. 1 illustrates a wellsite system in which the present invention can be employed.

FIG. 1 illustrates a wellsite system in which the present invention can be employed. The wellsite can be onshore or offshore. In this exemplary system, a borehole (11) is formed in subsurface formations by rotary drilling in a manner that is well known. Embodiments of the invention can also use directional drilling, as will be described hereinafter.

A drill string (12) is suspended within the borehole (11) and has a bottom hole assembly (100) which includes a drill bit (105) at its lower end. The surface system includes platform and derrick assembly (10) positioned over the borehole (11), the assembly (10) including a rotary table (16), kelly (17), hook (18) and rotary swivel (19). The drill string (12) is rotated by the rotary table (16), energized by means not shown, which engages the kelly (17) at the upper end of the drill string. The drill string (12) is suspended from a hook (18), attached to a traveling block (also not shown), through the kelly (17) and a rotary swivel (19) which permits rotation of the drill string relative to the hook. As is well known, a top drive system could alternatively be used.

In the example of this embodiment, the surface system further includes drilling fluid or mud (26) stored in a pit (27) formed at the well site. A pump (29) delivers the drilling fluid (26) to the interior of the drill string (12) via a port in the swivel (19), causing the drilling fluid to flow downwardly through the drill string (12) as indicated by the directional arrow (8). The drilling fluid exits the drill string (12) via ports in the drill bit (105), and then circulates upwardly through the annulus region between the outside of the drill string and the wall of the borehole, as indicated by the directional arrows (9). In this well known manner, the drilling fluid lubricates the drill bit (105) and carries formation cuttings up to the surface as it is returned to the pit (27) for recirculation.

The bottom hole assembly (100) of the illustrated embodiment includes a logging-while-drilling (LWD) module (120), a measuring-while-drilling (MWD) module (130), a rotary-steerable system and motor, mud motor (160), and drill bit (105).

The LWD module (120) is housed in a special type of drill collar, as is known in the art, and can contain one or a plurality of known types of logging tools. It will also be understood that more than one LWD and/or MWD module can be employed, e.g. as represented at (120A). (References, throughout, to a module at the position of (120) can alternatively mean a module at the position of (120A) as well.) The LWD module includes capabilities for measuring, processing, and storing information, as well as for communicating with the surface equipment. In the present embodiment, the LWD module includes a pressure measuring device.

The MWD module (130) is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

The mud motor (160) may be installed at any of various positions along the drilling tool. The motor can be used to locally convey power to the drill bit, to steer the drill bit in a desired drilling direction, and to increase the rotational speed of the drill bit in rotary steerable systems. Downhole sensors or gauges associated with the mud motor, drilling tool and wellbore provide information about downhole conditions such as wellbore pressure, weight on bit, torque on bit, direction, inclination, collar rpm, tool temperature, annular temperature and toolface, among others. The information collected by the sensors is made available to the various parts of the drilling system and the surface control unit.

Figure 2:
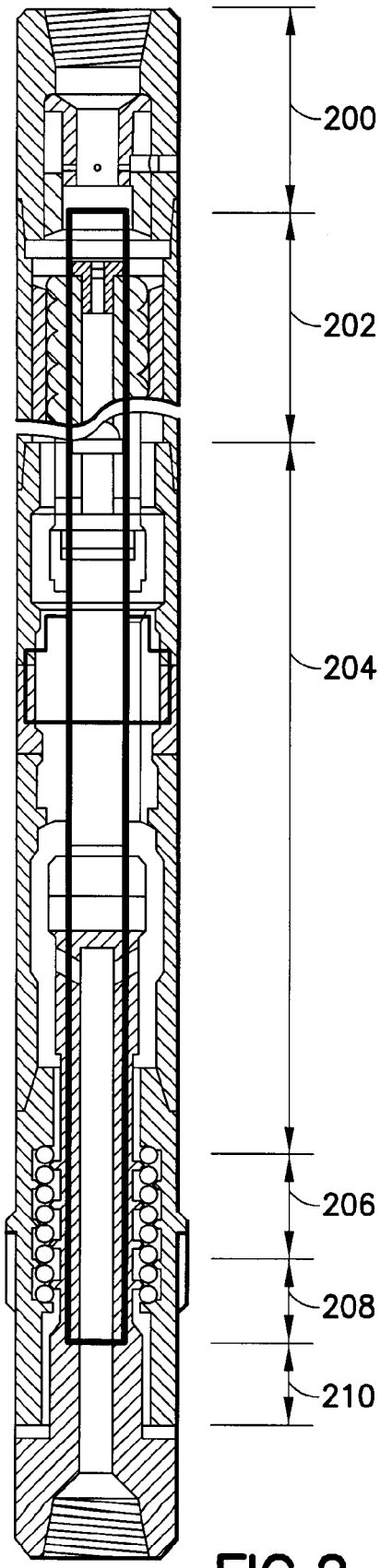
FIG. 2 illustrates the mud motor of FIG. 1 in greater detail.

FIG. 2 is a cross-sectional view of the mud motor (160) of FIG. 1. The motor includes a top section (200), a power section (202), a transmission section (204), a bearing section (206), a bearing bottom (208), and a top drive shaft (210). For dynamic analysis of vibration effects only three main sections are considered: the power section (202), the transmission shaft section (204), and the bearing section (206). A computational model is used to compute torsional, axial and lateral vibration effects introduced by the mud motor in association with the three sections. In particular, different computation modules are used for each of the three main sections.

For modeling purposes the drilling tool is divided into a discrete number of segments using an appropriate segment length, typically in the order of 1-4 diameters. Each segment is modeled as a rigid body. Adjacent segments are modeled as being connected through a set of springs that constrain relative motion between the segments. Axial, shear, torsional and bending springs are included in the model. The spring constants are computed based on the local cross section of the tool, the length of the segments, and the elastic properties of the collar material, as will be described in greater detail below. Along the mud motor, each segment includes two rigid bodies: an outer body corresponding to the collar, and an inner body corresponding to the rotor.

Figure 3:
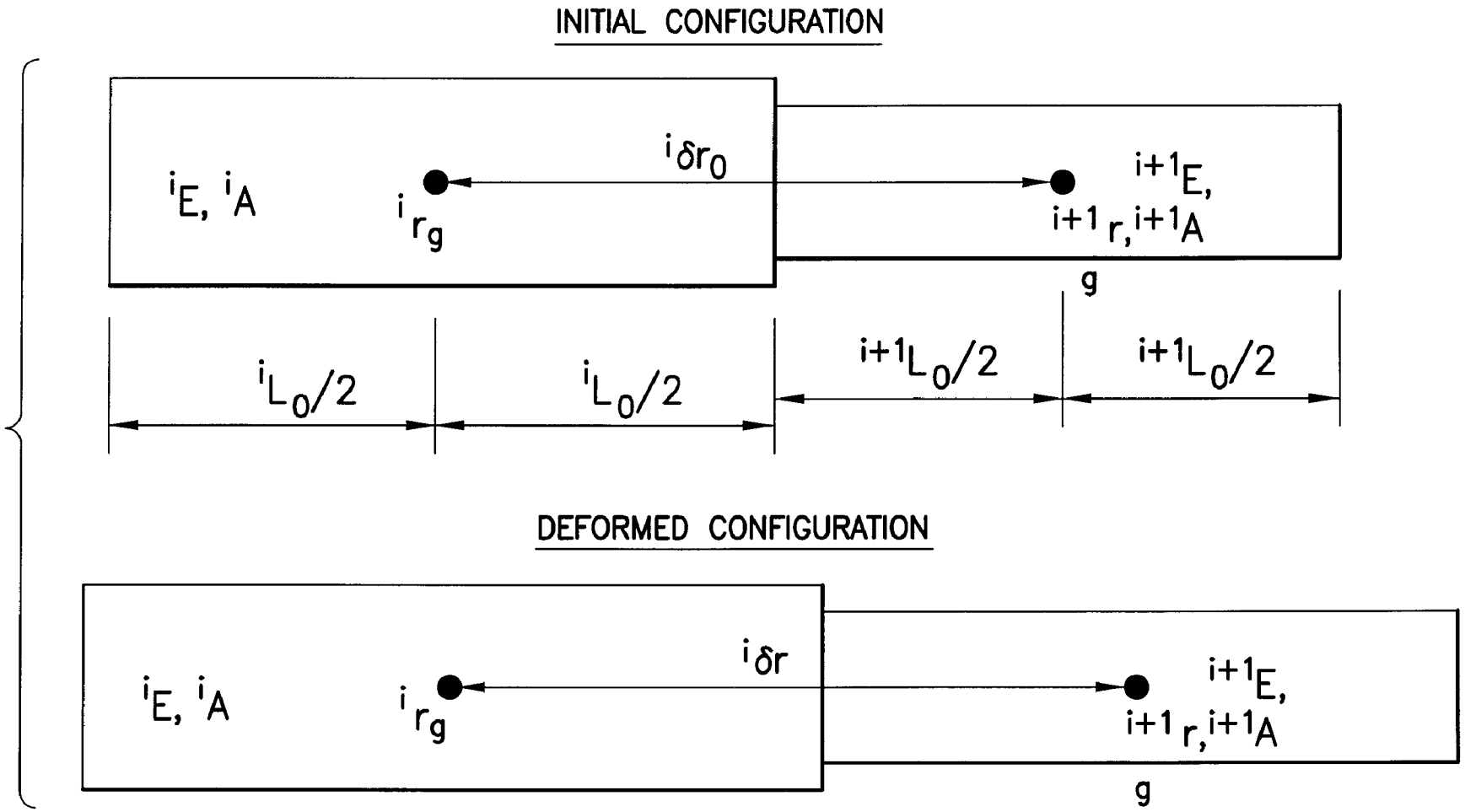
FIG. 3 illustrates parameters and geometry for computing the internal extensional force between two adjacent segments of the mud motor.

FIG. 3 illustrates parameters and geometry for computing the internal extensional force between two adjacent segments. The top portion of the figure shows the two segments (i and i+1) in the initial, undeformed configuration. Point rg denotes the geometric center of a segment, A represents its cross section area, L represents its length, and E represents the Young's modulus of the material. Initially, the distance between geometric centers is given by ${}^{i}\delta r_0=({}^{i}L_0+{}^{i+1}L_0)/2$ The lower portion of the figure shows the segments in a deformed (stretched) configuration. The extensional force acting between the two segments is then given by $$ {}^{i}F_{ext} = {}^{i}K_{ext} * (\|{}^{i}\delta r\| - {}^{i}\delta r_0) * \frac{{}^{i}\delta r}{\|{}^{i}\delta r\|}, $$

where ${}^{i}K_{ext}$ is the extensional stiffness between the two geometric centers. That stiffness is in turn given by, $$ {}^{i}K_{ext} = \frac{1}{\frac{{}^{i}L}{2{}^{i}E{}^{i}A} + \frac{{}^{i+1}L}{2{}^{i+1}E{}^{i+1}A}}, $$

which is the harmonic average of the extensional stiffnesses (2EA/L), of the two half BHA segments in between ${}^{i}r_g$ and ${}^{i+1}r_g$. The extensional force is assumed to have a line of action that coincides with the line connecting the geometric centers of the two segments.

Figure 4:
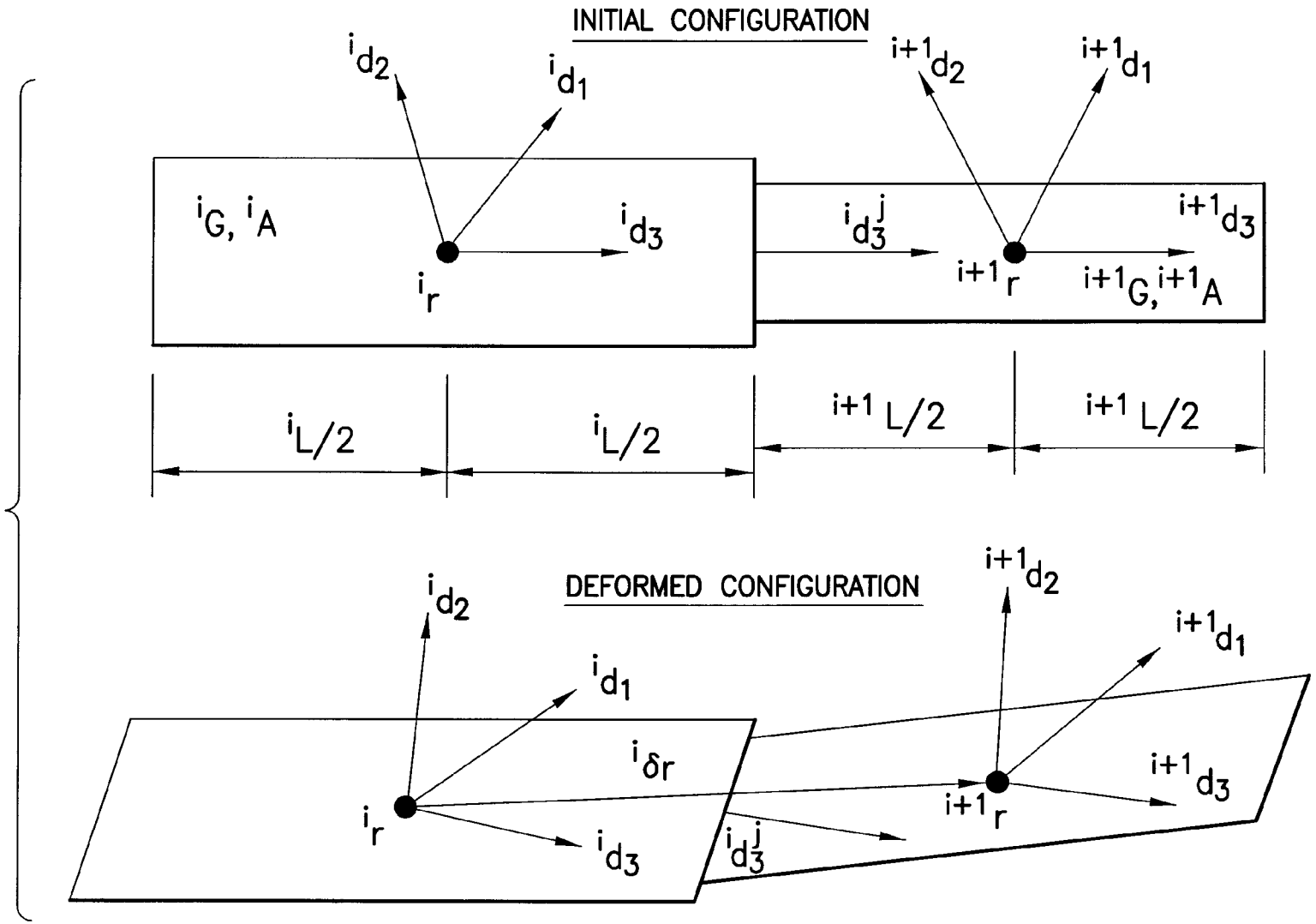
FIG. 4 illustrates parameters and geometry for computing internal shear force between two adjacent segments of the mud motor.

FIG. 4 illustrates parameters and geometry for computing internal shear force between two adjacent segments. The top portion shows the two segments (i and i+1) in the initial, undeformed configuration. Point $r_g$ denotes the geometric center of a segment, $d_{1,2}$ are the principal direction vectors of the segment cross section, $d_3=d_1\times d_2$ is the normal to the cross section, A is the cross section area, L the length, and G represents the shear modulus of the material. The additional unit vector, $d_3^j$, represents the normal to the cross section at the joint between the two adjacent segments. For this embodiment the principal vectors, $d_{1,2}$, of two adjacent sections, do not need to be aligned in the undeformed configuration. However, the unit normals, $d_3$ are aligned, i.e., no elbow joints. The lower portion of the figure shows the two adjacent BHA segments in a typical shear deformed state. The position and principal directions of each segment are assumed known. The normal to the cross section at the joint, $d_3^j$, is also assumed known.

Given that deformed geometry, the shear force is computed as $$^iF_{shear}={}^iK_{shear}*[{}^id_3^j-({}^id_3^j\cdot{}^it)^it],$$

where $^iK_{shear}$ is the equivalent/average shear stiffness of the two BHA segments. t is the unit vector tangent to the BHA centerline curve at the joint, and is assumed to be aligned with the line connecting the geometric centers of the adjacent segments. The expression in brackets represents the component of $d_3^j$ that is perpendicular to t (the magnitude of this component represents the angle between $d_3^j$ and t, and its direction gives the direction of the shear force). The shear stiffness is in turn given by, $$^iK_{shear}=\frac{^iL+{}^{i+1}L}{\frac{^iL}{^iG^iA}+\frac{^{i+1}L}{^{i+1}G^{i+1}A}},$$

which is the length weighted harmonic average of the shear stiffnesses (GA) of the two adjacent BHA segments. This expression is accurate for pure shear assumption, i.e., when the shear stress is uniform over the cross section, and the cross section remains flat. Because that assumption is not precisely correct for the case of beams undergoing shear, an effective shear stiffness is used by scaling down the expression above with a shear coefficient which depends on the type of cross section. That is, $$^iK_{shear}=\alpha_{shear}\frac{^iL+{}^{i+1}L}{\frac{^iL}{^iG^iA}+\frac{^{i+1}L}{^{i+1}G^{i+1}A}},$$

where, $0<\alpha_{shear}<1$.

Figure 5:
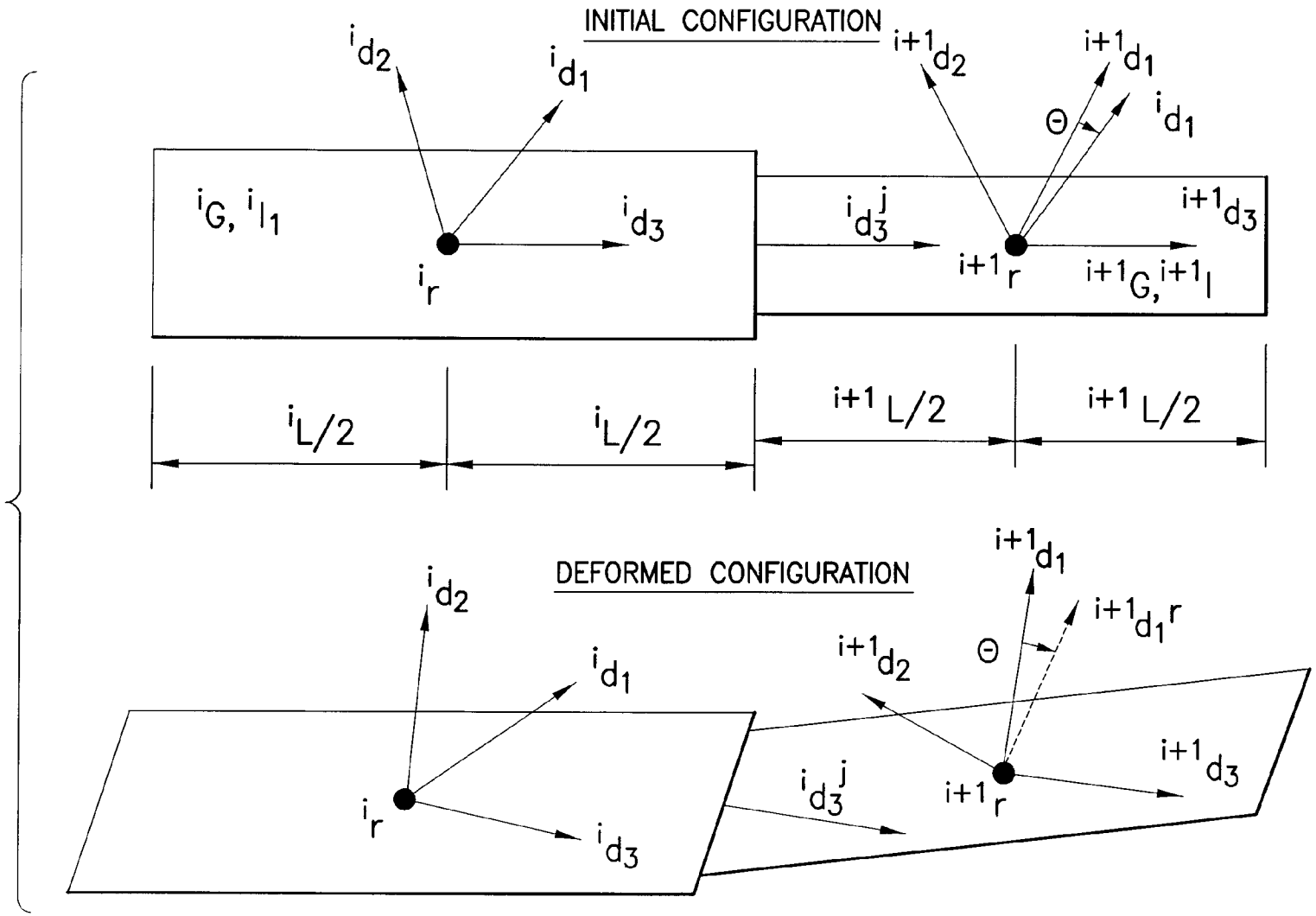
FIG. 5 illustrates parameters and geometry for computing the internal torsional moment between two adjacent segments of the mud motor.

FIG. 5 illustrates parameters and geometry for computing the internal torsional moment between two adjacent segments. The top portion shows the two segments (i and i+1) in the initial, undeformed configuration. I represents the torsional moment of inertia of the BHA segment cross section, and θ, which represents the initial angle between the principal directions of the two adjacent segments. An assumption is made that the principal vectors, $d_{1,2}$, of two adjacent segments do not need to be aligned in the undeformed configuration. However, the unit normals, $d_3$ are aligned. The lower potion shows the two adjacent BHA segments in a typical torsionally deformed state. The position and principal directions of each segment are assumed known. As before, the normal to the cross section at the joint, $d_3^j$, is also assumed known. The unit vector, $^{i+1}d_1^r$, is obtained by rotating $^{i+1}d_1$, around $^{1+1}d_3$, by the initial misalignment angle, θ, described above. This is done to remove the initial angle offset between the direction vectors of the two sections. Given that deformed geometry, the torsional moment is computed as $$^iM_{tor}={}^iK_{tor}*[({}^id_1\times{}^{i+1}d_1^r)\cdot{}^id_3^j]*{}^id_3^j,$$

where $^iK_{tor}$ is the equivalent/average torsional stiffness of the two BHA segments. The expression in brackets represents the component of the vector representing the rotation from $^id_1$ to $^{i+1}d_1^r$ that is along the direction of $d_3^j$. The magnitude of this component is the torsional rotation angle. As the expression reads, the direction of the torsional moment is along $d_3^j$. The torsional stiffness is in turn given by, $$^iK_{tor}=\frac{1}{\frac{^iL}{2^iG^iI}+\frac{^{i+1}L}{2^{i+1}G^{i+1}I}},$$

which is the harmonic average of the torsional stiffnesses (2GI/L) of the two adjacent half BHA segments. The actual expression used for the torsional moment is modified in the embodiment to the following:

$$^iM_{tor}={}^iK_{tor}*0.5*[({}^id_1\times{}^{i+1}d_1^r+{}^id_2\times{}^{i+1}d_2^r)\cdot{}^id_3^j]*{}^id_3^j.$$

This is to give equal weight to rotations of $d_1$ and $d_2$ in the computation.

Figure 6:
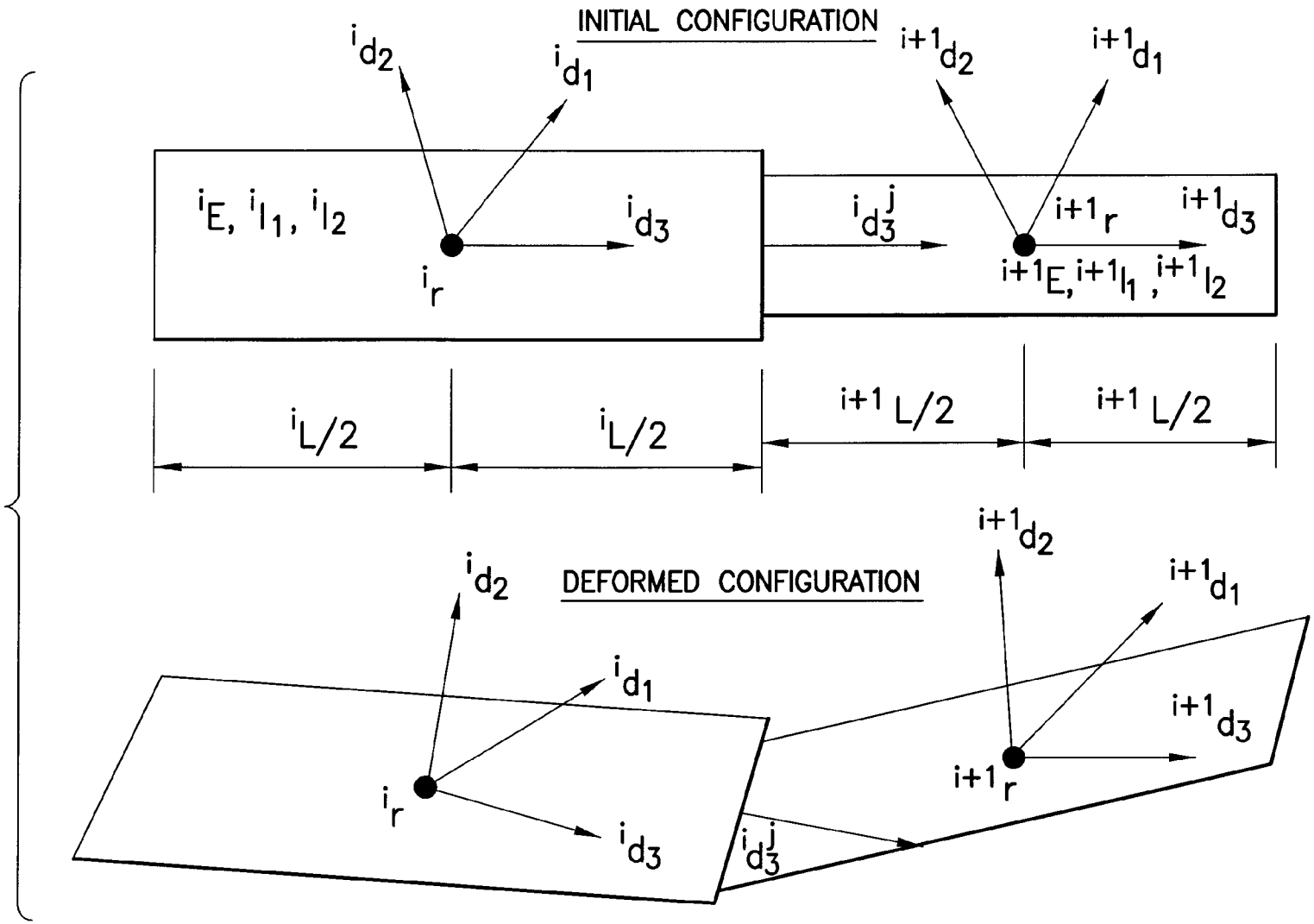
FIG. 6 illustrates geometry and parameters for computing the internal bending moment between two adjacent segments of the mud motor.

FIG. 6 illustrates geometry and parameters for computing the internal bending moment between two adjacent segments. The top portion shows the two segments (i and i+1) in the initial, undeformed configuration. The two bending moments of inertia are represented by $I_1$, $I_2$. Again, the assumption is made that the principal vectors, $d_{1,2}$, of two adjacent segments do not need to be aligned in the undeformed configuration. However, the unit normals, $d_3$ are aligned. The lower portion shows the two adjacent BHA segments in a typical bent state. The position and principal directions of each segment are assumed known. Given that deformed geometry, the bending moment is computed using the following procedure. First, compute the bending moment in the local coordinate system of the left BHA segment. The moment can be expressed as, $$^iM_b={}^iM_{1b}*{}^id_1+{}^iM_{2b}*{}^id_2,$$

where $^iM_{1b,b2}$ are the components of the bending moment along the principal directions $^id_{1,2}$. Those components will cause rotations of $^id_3$ around $^id_{1,2}$ when moving from the center of the left segment to the joint. Those rotations are given by $$^irot_{1l}={}^iM_{1b}*\frac{^iL}{2^iE^iI_1}$$

and $$^irot_{2l}={}^iM_{2b}*\frac{^iL}{2^iE^iI_2}.$$

Or, expressed in matrix notation:

$$\begin{bmatrix}^irot_{1l}\\^irot_{2l}\end{bmatrix}=\frac{^iL}{2^iE}\begin{bmatrix}\frac{1}{^iI_1}&0\\0&\frac{1}{^iI_2}\end{bmatrix}\begin{bmatrix}^iM_{1b}\\^iM_{2b}\end{bmatrix}$$

Those bending moment components will also cause additional rotations of ${}^{i}d_3$ around ${}^{i}d_{1,2}$ when moving from the joint to the center of the right segment. However, because the principal directions of the right segment will in general differ from those of the left, the expression for those additional rotations is given by, $$\begin{bmatrix} {}^{i}rot_{1r} \\ {}^{i}rot_{2r} \end{bmatrix} = \frac{{}^{i+1}L}{2^{i+1}E}\begin{bmatrix} {}^{i}d_1 \cdot {}^{i+1}d_1 & {}^{i}d_1 \cdot {}^{i+1}d_2 \\ {}^{i}d_2 \cdot {}^{i+1}d_1 & {}^{i}d_2 \cdot {}^{i+1}d_2 \end{bmatrix}\begin{bmatrix} \frac{1}{{}^{i+1}I_1} & 0 \\ 0 & \frac{1}{{}^{i+1}I_2} \end{bmatrix}\begin{bmatrix} {}^{i+1}d_1 \cdot {}^{i}d_1 & {}^{i+1}d_1 \cdot {}^{i}d_2 \\ {}^{i+1}d_2 \cdot {}^{i}d_1 & {}^{i+1}d_2 \cdot {}^{i}d_2 \end{bmatrix}\begin{bmatrix} {}^{i}M_{1b} \\ {}^{i}M_{2b} \end{bmatrix}$$

or $$\begin{bmatrix} {}^{i}rot_{1r} \\ {}^{i}rot_{2r} \end{bmatrix} = \frac{{}^{i+1}L}{2^{i+1}E}[{}^{i}C^{i+1}]\begin{bmatrix} \frac{1}{{}^{i+1}I_1} & 0 \\ 0 & \frac{1}{{}^{i+1}I_2} \end{bmatrix}[{}^{i}C^{i+1}]^T\begin{bmatrix} {}^{i}M_{1b} \\ {}^{i}M_{2b} \end{bmatrix},$$

where $${}^{i}C^{i+1} = \begin{bmatrix} {}^{i}d_1 \cdot {}^{i+1}d_1 & {}^{i}d_1 \cdot {}^{i+1}d_2 \\ {}^{i}d_2 \cdot {}^{i+1}d_1 & {}^{i}d_2 \cdot {}^{i+1}d_2 \end{bmatrix},$$

is the second rank coordinate transformation tensor between the two sets of principal directions. In essence, first express ${}^{i}M_{1b,2b}$ in terms of their components along the principal directions ${}^{i+1}d_{1,2}$ of the right segment, then compute the rotations of ${}^{i+1}d_3$ along those right segment principal directions, and finally transform back the rotations to the principal directions of the left segment. The total rotation of $d_3$ around ${}^{i}d_{1,2}$ when going from the center of the left segment to the center of the right segment is given by, $$\begin{bmatrix} {}^{i}rot_1 \\ {}^{i}rot_2 \end{bmatrix} = \left\{\frac{{}^{i}L}{2^{i}E}\begin{bmatrix} \frac{1}{{}^{i}I_1} & 0 \\ 0 & \frac{1}{{}^{i}I_2} \end{bmatrix} + \frac{{}^{i+1}L}{2^{i+1}E}[{}^{i}C^{i+1}]\begin{bmatrix} \frac{1}{{}^{i+1}I_1} & 0 \\ 0 & \frac{1}{{}^{i+1}I_2} \end{bmatrix}[{}^{i}C^{i+1}]^T\right\}\begin{bmatrix} {}^{i}M_{1b} \\ {}^{i}M_{2b} \end{bmatrix}$$

Now, given the assumption that in the undeformed configuration the unit vectors ${}^{i}d_3$ and ${}^{i+1}d_3$ are aligned, then the rotations ${}^{i}rot_{1,2}$ are given by, $${}^{i}rot_1 = ({}^{i}d_3 \times {}^{i+1}d_3) \cdot {}^{i}d_1$$

and $${}^{i}rot_2 = ({}^{i}d_3 \times {}^{i+1}d_3) \cdot {}^{i}d_2$$

Given those rotations the components of the bending moment are given by, $$\begin{bmatrix} {}^{i}M_{1b} \\ {}^{i}M_{2b} \end{bmatrix} = \left[\frac{{}^{i}L}{2^{i}E}\begin{bmatrix} \frac{1}{{}^{i}I_1} & 0 \\ 0 & \frac{1}{{}^{i}I_2} \end{bmatrix} + \frac{{}^{i+1}L}{2^{i+1}E}[{}^{i}C^{i+1}]\begin{bmatrix} \frac{1}{{}^{i+1}I_1} & 0 \\ 0 & \frac{1}{{}^{i+1}I_2} \end{bmatrix}[{}^{i}C^{i+1}]^T\right]^{-1}\begin{bmatrix} ({}^{i}d_3 \times {}^{i+1}d_3) \cdot {}^{i}d_1 \\ ({}^{i}d_3 \times {}^{i+1}d_3) \cdot {}^{i}d_2 \end{bmatrix}$$

or $$\begin{bmatrix} {}^{i}M_{1b} \\ {}^{i}M_{2b} \end{bmatrix} = [{}^{i}K_b]\begin{bmatrix} ({}^{i}d_3 \times {}^{i+1}d_3) \cdot {}^{i}d_1 \\ ({}^{i}d_3 \times {}^{i+1}d_3) \cdot {}^{i}d_2 \end{bmatrix},$$

where $$[{}^{i}K_b] = \left[\frac{{}^{i}L}{2^{i}E}\begin{bmatrix} \frac{1}{{}^{i}I_1} & 0 \\ 0 & \frac{1}{{}^{i}I_2} \end{bmatrix} + \frac{{}^{i+1}L}{2^{i+1}E}[{}^{i}C^{i+1}]\begin{bmatrix} \frac{1}{{}^{i+1}I_1} & 0 \\ 0 & \frac{1}{{}^{i+1}I_2} \end{bmatrix}[{}^{i}C^{i+1}]^T\right]^{-1},$$

is the bending stiffness tensor of the two BHA segments when expressed in the principal directions of the left segment. Using a similar procedure, but using the local coordinate system of the right segment it is possible to arrive at, $$\begin{bmatrix} {}^{i+1}M_{1b} \\ {}^{i+1}M_{2b} \end{bmatrix} = [{}^{i+1}K_b]\begin{bmatrix} ({}^{i}d_3 \times {}^{i+1}d_3) \cdot {}^{i+1}d_1 \\ ({}^{i}d_3 \times {}^{i+1}d_3) \cdot {}^{i+1}d_2 \end{bmatrix}$$

with $$[{}^{i+1}K_b] = \left[\frac{{}^{i}L}{2^{i}E}[{}^{i}C^{i+1}]^T\begin{bmatrix} \frac{1}{{}^{i}I_1} & 0 \\ 0 & \frac{1}{{}^{i}I_2} \end{bmatrix}[{}^{i}C^{i+1}] + \frac{{}^{i+1}L}{2^{i+1}E}\begin{bmatrix} \frac{1}{{}^{i+1}I_1} & 0 \\ 0 & \frac{1}{{}^{i+1}I_2} \end{bmatrix}\right]^{-1}$$

Now, in order to avoid (left or right) biasing of the computations, the actual bending moment is computed as the average of the two. That is, ${}^{i}M_b = 0.5*\{({}^{i}M_{1b}*{}^{i}d_1 + {}^{i}M_{2b}*{}^{i}d_2) + ({}^{i+1}M_{1b}*{}^{i+1}d_1 + {}^{i+1}M_{2b}*{}^{i+1}d_2)\}$ Once the bending moment is computed, it can be used to determine the orientation of the normal to the cross section at the joint, ${}^{i}d_3{}^{j}$. To do this, compute the rotations of $d_3$ from the centers of the two adjacent segments to the joint. Given the rotations of ${}^{i}d_3$ from the center of the left segment to the joint, $$\begin{bmatrix} {}^{i}rot_{1l} \\ {}^{i}rot_{2l} \end{bmatrix} = \frac{{}^{i}L}{2^{i}E}\begin{bmatrix} \frac{1}{{}^{i}I_1} & 0 \\ 0 & \frac{1}{{}^{i}I_2} \end{bmatrix}\begin{bmatrix} {}^{i}M_b \cdot {}^{i}d_1 \\ {}^{i}M_b \cdot {}^{i}d_2 \end{bmatrix},$$

it is possible to compute ${}^{i}d_3{}^{j}$ as, $${}^{i}d_3{}^{j} = {}^{i}rot_{2l}*{}^{i}d_1 - {}^{i}rot_{1l}*{}^{i}d_2 + \sqrt{(1-({}^{i}rot_{1l})^2-({}^{i}rot_{2l})^2)}*{}^{i}d_3$$

Similarly, given the rotations of ${}^{i+1}d_3$ from the center of the right segment to the joint, $$\begin{bmatrix} {}^{i+1}rot_{1r} \\ {}^{i+1}rot_{2r} \end{bmatrix} = -\frac{{}^{i+1}L}{2\,{}^{i+1}E}\begin{bmatrix} \frac{1}{{}^{i+1}I_1} & 0 \\ 0 & \frac{1}{{}^{i+1}I_2} \end{bmatrix}\begin{bmatrix} {}^{i}M_b \cdot {}^{i+1}d_1 \\ {}^{i}M_b \cdot {}^{i+1}d_2 \end{bmatrix},$$

it is possible to compute ${}^{i}d_3^{j}$ as, $${}^{i+1}d_{3r}^{j} = -{}^{i+1}rot_{2r} * {}^{i+1}d_1 + {}^{i+1}rot_{1r} * {}^{i+1}d_2 + \sqrt{(1-({}^{i+1}rot_{1r})^2-({}^{i+1}rot_{2r})^2)} * {}^{i+1}d_3$$

Once again, in order to avoid biasing of the computation, the normal at the joint is the average of those two computed vectors. That is, $${}^{i}d_3^{j} = \frac{{}^{i}d_{3l}^{j} + {}^{i+1}d_{3r}^{j}}{\|{}^{i}d_{3l}^{j} + {}^{i+1}d_{3r}^{j}\|}$$

Figure 7:
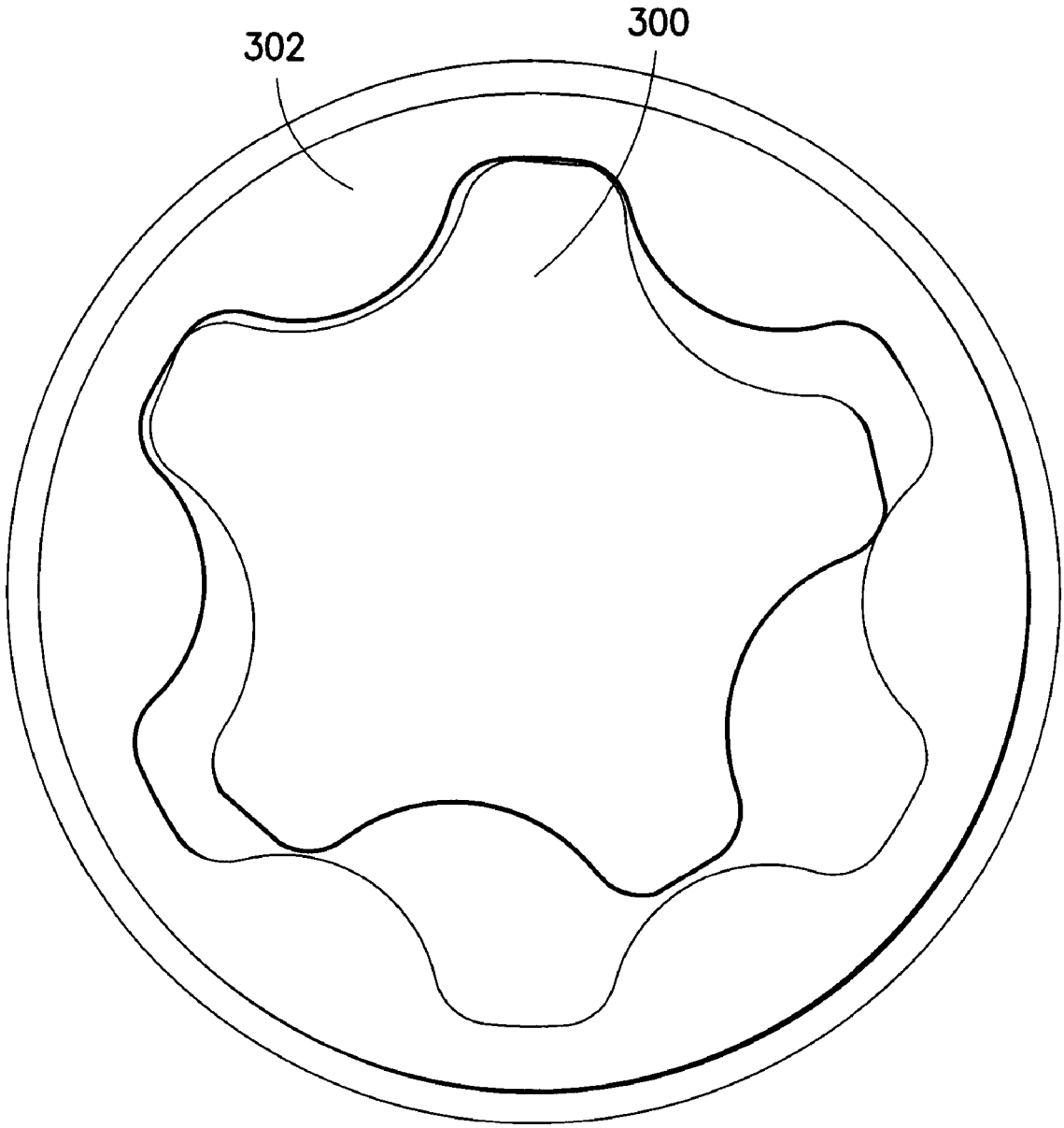
FIG. 7 illustrates geometry of the mating rotor and stator surfaces of the power section of the mud motor of FIG. 2.
Figure 8:
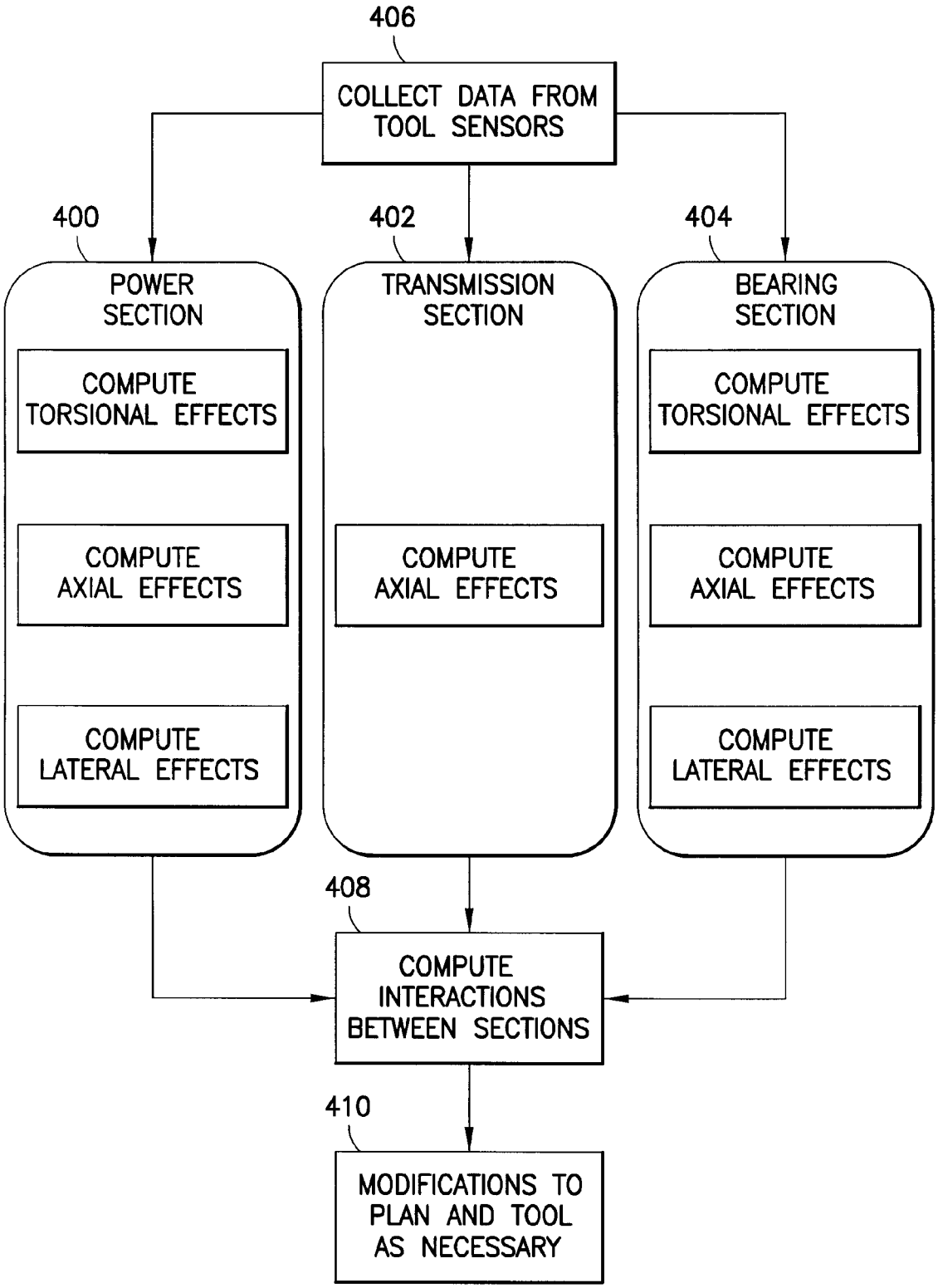
FIG. 8 is a flow diagram of building a model based on the proposed tool design and drilling conditions.

Referring now to FIGS. 2, 7 and 8, embodiments of a computational model of the mud motor that can be incorporated in Finite Elements (FE) or Finite Differences (FD) based transient dynamic simulations of a drilling assembly that includes a mud motor will be described. Although the specifically described model is based on a finite difference approach, it is to be understood that the same model may be implemented when using finite elements, or similar computational approaches. The model may be computerized such that calculations and other functions are performed by software stored on a computer-readable medium and executed off-site or on-site, e.g., by the logging and control module (162). The software includes a power section module (400), a transmission section module (402), and a bearing section module (404). The modules may use data collected from sensors in step (406) to help refine the models. In particular, the power section module (400) and bearing section module (404) each compute torsional, axial and lateral effects, and the transmission section module (402) computes axial effects. Interactions between the sections are then computed in step (408). The result is used to modify the drilling plan, tool operation parameters, tool configuration, or other factors in order to increase the likelihood of achieving a set of goals for the drilling operation as indicated in step (410).

With regard to the computation module (400) for the power section (202), the torsional interaction between stator (300) and rotor (302), and the lateral excitation on the stator due to the whirling motion (nutation) of the rotor as is turns, are both modeled. Along the power section hydraulic energy from the flowing mud is converted into mechanical rotational energy. In particular, the pressurized mud flow forces the eccentric rotor to turn inside the stator. The torque generated by the flowing mud is a function of the pressure differential across the motor and frictional losses due to relative movement of the rotor. The frictional losses generally increase with the speed of the rotor with respect to the stator, resulting in a torque versus motor speed behavior that shows a maximal torque at zero speed (stall condition), and gradually decreases with speed down to zero torque at a maximal speed, i.e., no load RPM. The torque versus speed dependency can have significant effects on the dynamic performance of the tool. Additionally, because of the geometry of the mating rotor and stator surfaces as illustrated in FIG. 3, the rotor whirls as it turns, moving in a circular path with respect to the center of the stator. The lateral motion of the rotor, and in particular the lateral motion induced on the drilling tool because of this, can have a significant effect on the dynamic performance of the drilling tool.

Torsional and lateral interaction between the collar and the rotor for the power section are independently calculated for computational efficiency. With regard to the torsional interaction, a functional relationship between the motor rotational speed and torque being transmitted is assumed to be $T=T(\omega_r-\omega_c)$, where $\omega_r$ is the rotor speed and $\omega_c$ is the collar, i.e. stator speed. It is recognized that the relationship also depends on other parameters, such as pressure drop and mud flow, which could be incorporated into the model. Various models can be used to represent the functional relationships between torque and motor speed. For example, a linear model defined by a straight line between a stall torque (maximum torque at zero speed) and a no load speed (maximum speed at zero torque) could be used. A quadratic model in which the motor performance curve is defined by a quadratic curve with the flow rate as a parameter and curve coefficients fitted from experiment data could be used. A higher order parametric model could also be used.

The equations of motion for the six degrees of freedom of the collar (outer) segment, plus the rotation of the rotor are:

$$m_c\dot{v}_c = \vec{F}_c$$

$$I_{c1}\dot{\omega}_{c1} = (I_{c3} - I_{c2})\omega_{c2}\omega_{c3} + T_{c1}$$

$$I_{c2}\dot{\omega}_{c2} = (I_{c1} - I_{c3})\omega_{c3}\omega_{c1} + T_{c2}$$

$$I_{c3}\dot{\omega}_{c3} = (I_{c2} - I_{c1})\omega_{c1}\omega_{c2} + T_{c3} - \frac{1}{n_{pow}}T_{motor}(\omega_{r3} - \omega_{c3})$$

and $$I_{r3}\dot{\omega}_{r3} = \frac{1}{n_{pow}}T_{motor}(\omega_{r3} - \omega_{c3}) + T_{s3}$$

where the subscript "c" represents collar related quantities, and "r" represents rotor related quantities. Numerical subscript "3" represents the local axial direction of the drilling tool, while subscripts "1, 2" represent the two lateral directions. Those three directions are the principal directions of the segment. The variable m is the segment mass. $I_{1,2,3}$ are the rotational moments of inertia of the segment along each of the principal directions. The variable v represents the translational velocity vector. $\omega_{1,2,3}$ represents the rotational speeds along the principal directions. F represents net force vectors from the aggregate of internal forces due to the elastic connections between adjacent segments and external forces such as mud drag and borehole wall reaction forces. T represents net torques (or moments), i.e., from the aggregate of internal and external forces and moments. $n_{pow}$ represents the number of finite difference segments comprising the power section of the motor. Consequently, there are seven equations for seven unknowns, i.e., three translational and three rotational accelerations of the collar, and the axial rotational acceleration of the rotor. Those equations can be solved using an iterative procedure such as that described below.

The equations of motion for a typical BHA segment (considered as a rigid body) when written in the segment principal axes, $d_{1,2,3}$, are:

$$m_i * \dot{v}_i = F_i(v_j, \omega_j)$$

$$I_1 * \dot{\omega}_1 = (I_3 - I_2) * \omega_2 * \omega_3 + T_i(v_j, \omega_1)$$

$$I_2 * \dot{\omega}_2 = (I_1 - I_3) * \omega_3 * \omega_1 + T_i(v_j, \omega_2)$$

$$I_3 * \dot{\omega}_3 = (I_2 - I_1) * \omega_1 * \omega_2 + T_i(v_j, \omega_3)$$

where i,j=1,2,3, $F_i$ and $T_i$, represent the net Forces and Torques acting on the BHA segment along each of its principal dimensions, including those due to the mud, and therefore they are presented as functions of the segment linear and angular speeds. This is a system of 6 coupled non-linear differential equations. It is possible to use Newton-Raphson iteration as a solution procedure. Using central differences the equations can be written in general form as:

$$M\frac{\Delta x^n}{\Delta t} = f\left(\frac{x^{n+1}+x^n}{2}\right),$$

where x is the vector of translational and angular speeds, M is the inertia matrix, f is the vector of forcing functions, and $x^{n+1}=x^n+\Delta x$. As a first iteration, the set of equations is approximated by first order expansion of the forcing function around $$x^n \cdot M\frac{\Delta x_1^n}{\Delta t} = f(x^n) + \left[\frac{\partial f}{\partial x}\right]_{x^n}\frac{\Delta x_1^n}{2}$$

or $$\left\{\frac{M}{\Delta t} - \frac{1}{2}\left[\frac{\partial f}{\partial x}\right]_{x^n}\right\}\Delta x_1^n = f(x^n),$$

which can be used to compute a first estimate of the speed increments, $\Delta x_1$. Once a first estimate is computed it is possible to refine the solution by using the modified expression:

$$M\frac{\Delta x_{k+1}^n}{\Delta t} = f\left(x^n + \frac{\Delta x_k^n}{2}\right) + \left[\frac{\partial f}{\partial x}\right]_{x^n+\frac{\Delta x_k^n}{2}}\frac{\Delta x_{k+1}^n - \Delta x_k^n}{2}$$

or equivalently:

$$\left\{\frac{M}{\Delta t} - \frac{1}{2}\left[\frac{\partial f}{\partial x}\right]_{x^n+\frac{\Delta x_k^n}{2}}\right\}\Delta x_{k+1}^n = f\left(x^n + \frac{\Delta x_k^n}{2}\right) - \left[\frac{\partial f}{\partial x}\right]_{x^n+\frac{\Delta x_k^n}{2}}\frac{\Delta x_k^n}{2}.$$

The iteration is stopped when a given convergence criteria is met. For instance, when $\|\Delta x_{k+1}{}^n - \Delta x_k{}^n\| < \epsilon$, where $\epsilon$ is a reasonably small constant.

With regard to the lateral excitation experienced by the collar due to the whirling motion of the inner rotor, it is assumed that in the absence of external forces, the lateral position, i.e., in the plane given by the local principal directions, $d_1$, $d_2$, of the collar segment, of the center of mass the collar-rotor two body system will tend to remain fixed as the rotor turns. Using the above equations, which neglect the effect of the rotor whirling, to compute the new collar position as well as the collar and rotor incremental axial rotations it is possible to compute the resultant relative displacement of the rotor with respect to the collar. From the result of that computation it is possible to compute the lateral displacement of the center of mass of the two-body system that would come as a result of that rotor movement. That center of mass displacement is then subtracted from the already computed collar position. The result is an additional lateral displacement imposed on the collar that will compensate for the natural tendency of the center of mass of the two body system to remain laterally unaltered.

Using as a reference the rotating coordinate system given by the principal axes of the collar, $d_{1,2,3}$, and assuming an initial condition with the center of the rotor lying along the $d_1$ direction, at any moment in time the angular position of the center of the rotor with respect to the d1 axis is given by:

$$\theta_r = -n\int_0^t (\omega_{r3} - \omega_{c3})dt,$$

where n is the number of lobes on the rotor cross-section. Note that the whirling rotation is much faster than the motor speed. The negative sign indicates that the direction of whirling rotation is opposite to the direction of rotation of the rotor with respect to the collar. The position of the rotor center is then given by:

$$r_r = a[\cos(\theta_r)d_1 + \sin(\theta_r)d_2],$$

where a is the rotor eccentricity, i.e., the radius of the circle traversed by the rotor centerline as it whirls inside the collar stator. The center of mass of the two-body system is:

$$r_{rc} = \frac{m_r}{m_c+m_r}r_r = \frac{am_r}{m_c+m_r}[\cos(\theta_r)d_1 + \sin(\theta_r)d_2]$$

where $m_c$ is the mass of the collar segment and $m_r$ is the mass of the corresponding rotor segment. After a time increment, $\Delta t$, the resultant incremental displacement of the center of mass due to an incremental whirling angle, $$\delta\theta_r = -n(\omega_{r3} - \omega_{c3})\Delta t,$$

will be:

$$\delta r_{rc} = \frac{am_r}{m_c+m_r}[(\cos(\theta_r+\delta\theta_r)d_1 + \sin(\theta_r+\delta\theta_r)d_2) - (\cos(\theta_r)d_1 + \sin(\theta_r)d_2)]$$

$$\delta r_{rc} = \frac{am_r}{m_c+m_r}\delta\theta_r(-\sin(\theta_r)d_1 + \cos(\theta_r)d_2)$$

Therefore, after the collar position has been updated according to the equations in the previous section, the incremental displacement, $-\delta r_{rc}$, is added to it in order to compensate for the whirling motion of the rotor. To compensate for the mud that fills the inner spaces between collar and rotor as well as the annular space between the collar and the borehole, it is possible to use relative densities, i.e., the density of the material minus the density of the mud, in the computation of the collar and rotor masses that go into the equations above.

It is also useful to compute the axial movement of the rotor because it can have an effect on axial vibrations that can be partially transmitted to the bit, and therefore may affect the dynamics of interaction between the drill bit and the formation. A single translational degree of freedom equation, $m_r\dot{v}_r = F_r$, may be utilized because only axial movement is of interest (the lateral effect has already been computed as described above). In that equation $v_r$ represents the axial velocity of the segment, and $F_r$ represents the net axial force acting on the rotor segment as a result of the axial elastic forces connecting the adjacent segments and limiting their relative axial displacement. Those axial elastic forces are computed as already described above. An assumption is made that the top-most segment of the rotor will not be subject to axial force coming from the top. However, net axial forces coming as a result of mud pressure differential along the rotor could also be included.

Along the transmission section, a shaft running inside the collar mechanically connects the rotor to the bottom of the BHA, which includes the drilling bit. The shaft and the collar are largely decoupled along this section, and therefore can be treated independently. The transmission section computation module solves for the six degrees of freedom of the collar using the standard equations of motion as already described above. Only axial movement and rotation are computed for the transmission shaft. The axial movement is computed as already described above for the rotor along the power section. For the rotation of the shaft, the single rotational degree of freedom equation of motion, $$I_s\dot{\omega}_s=T_s$$

is used. $I_s$ represents the rotational moment of inertia of the transmission shaft segment around the tool axis, $\omega_s$ represents the rotation speed, and $T_s$ represents the net axial torque acting on the transmission shaft segment as a result of the axial elastic torques connecting the adjacent segments and limiting their relative axial rotation. Those axial elastic torques are computed as already described above. Since the top-most segment of the transmission shaft is connected to the rotor on the power section, the elastic torque is computed appropriately in view of the properties of the adjacent rotor and transmission shaft segments. Similar treatment is given to the bottom segment of the transmission shaft, which is connected to the usually stiffer portion of the rotor along the bearing section.

The thrust bearing at the lower section of the motor transmits axial and lateral forces and bending moments between the collar and the rotor. Therefore, five of the degrees of freedom of the rotor (three translations and the two rotations orthogonal to the axis of the tool) are considered to be shared between collar and rotor. Only rotation around the tool axis is considered to be decoupled between collar and rotor. The inner rotor rotation is driven by the transmission shaft above, and constrained by interactions between the drill bit and formation below. The collar rotation is driven from the collar above it and has no torsional constraints below, i.e., zero torque condition at the bottom of the collar.

Prior to solving the equations of motion of the collar segments along the bearing, the mass of the collar corresponding rotor segments and rotational moments of inertia of collar and rotor segments along the principal lateral directions, $d_1$,$d_2$ are computed. Additionally in the computation of net elastic forces and torques acting among adjacent segments the axial, shear and bending stiffness of the rotor segments to those of the collar segments are included. The equations of motion for the collar segments along the bearing section then become:

$$(m_c+m_r)\dot{\vec{v}}_c=\vec{F}_c$$

$$(I_{c1}+I_{r1})\dot{\omega}_{c1}=(I_{c3}-(I_{c2}+I_{r2}))\omega_{c2}\omega_{c3}+T_{c1}$$

$$(I_{c2}+I_{r2})\dot{\omega}_{c2}=((I_{c1}+I_{r1})-I_{c3})\omega_{c3}\omega_{c1}+T_{c2}$$

$$I_{c3}\dot{\omega}_{c3}=((I_{c2}+I_{r2})-(I_{c1}+I_{r1}))\omega_{c1}\omega_{c2}+T_{c3}$$

These equations are used to update the positions and orientations of the collar segments along the bearing section. Note that the positions are shared by both the collar and corresponding rotor segment. However, only rotations along the principal axes, $d_1$,$d_2$, of the collar are shared. The axial rotation of the rotor (rotation around the tool axis) is updated using a single rotational degree of freedom equation as already described above.

The bottom-most segments of the bearing section are afforded separate consideration. It will be appreciated that the bottom-most collar segment is not rigidly coupled to the lower portion of the drilling tool. Consequently, there is no axial elastic force acting on it, and there is also no axial elastic torque. It should also be appreciated that segments of the drilling tool below the bearing, including the drilling bit, are rigidly connected to the bottom segment of the rotor on the bearing section. The standard equations of motion are used to solve for positions and orientations of the drilling tool segments below the bearing. The elastic forces and torques at the top of the top-most segment of this section of the drilling tool are computed based on relative displacements and rotation of that segment with respect to the bottom-most rotor segment on the bearing section. Other segments of the drilling tool are modeled as already described above.

Having computed the vibration effects introduced by the mud motor, the resulting information can be used to enhance planning and operation. For example, by incorporating the computations into a drilling plan it may be possible to improve the plan and configure the drilling tool in order to improve efficiency, reduce wear, enhance rate of drilling, or otherwise achieve goals. During drilling operations the vibration effects introduced by the mud motor can be computed in real time or near real time in order to adapt to conditions in order to improve efficiency, reduce wear, enhance rate of drilling, or otherwise achieve goals. For example, adjustments can be made to control parameters, and the tool may be reconfigured. It will be appreciated that the ability to quickly perform the computations helps to enable and enhance adaptation during drilling operations. As a result, improved drilling may be achieved.

Figure 9:
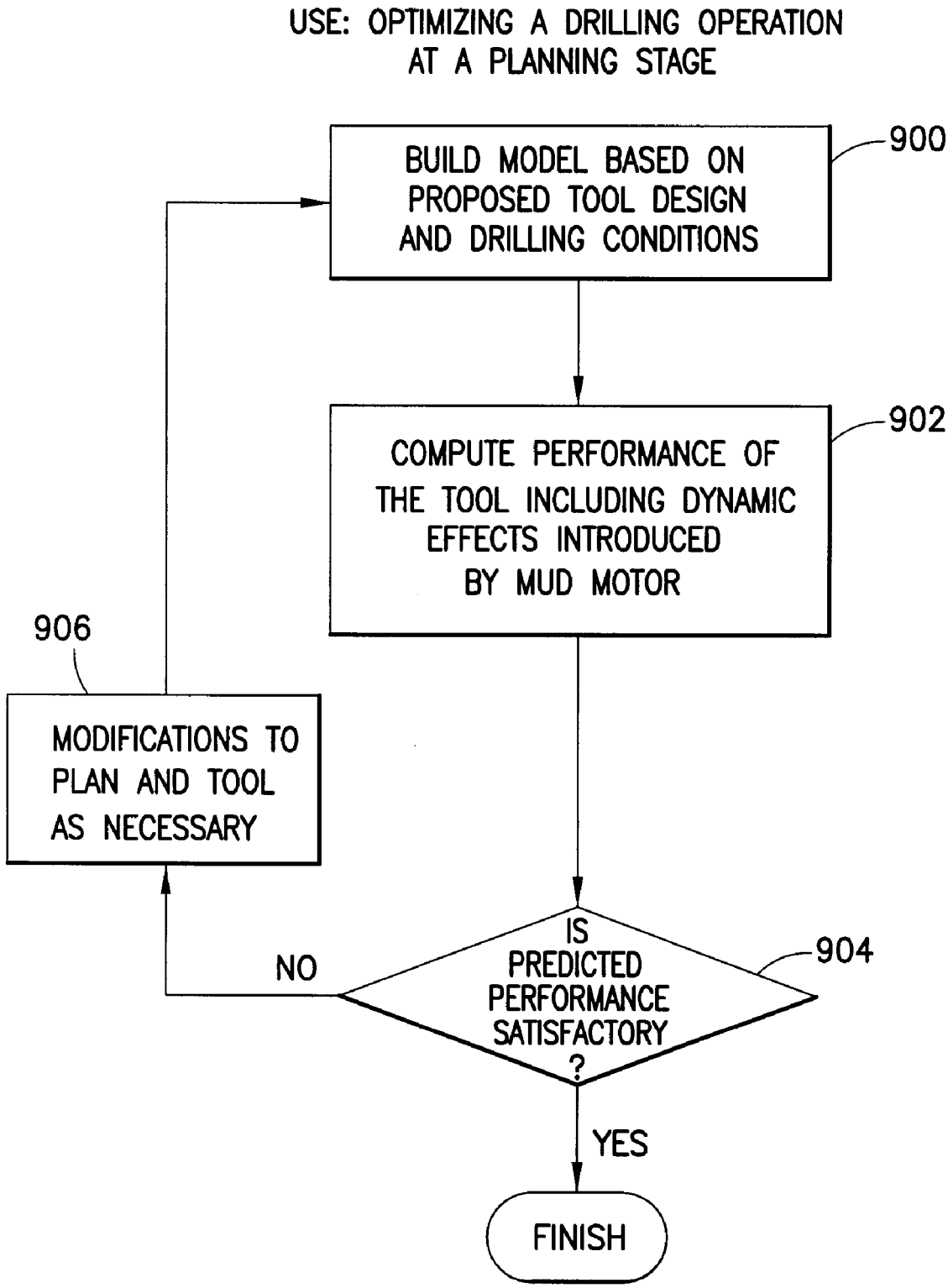
FIG. 9 is a flow diagram of optimizing a drilling operation at the planning stage.

FIG. 9 illustrates optimizing a drilling operation at the planning stage. In step (900) a model is built based on a proposed tool design and drilling conditions. Performance of the tool inclusive of dynamic effects introduced by the mud motor is then computed in step (902). If the predicted performance is satisfactory, as determined at step (904), then the procedure ends. However, if predicted performance is not satisfactory then modification may be made to the plan and tool as indicated in step (906).

Figure 10:
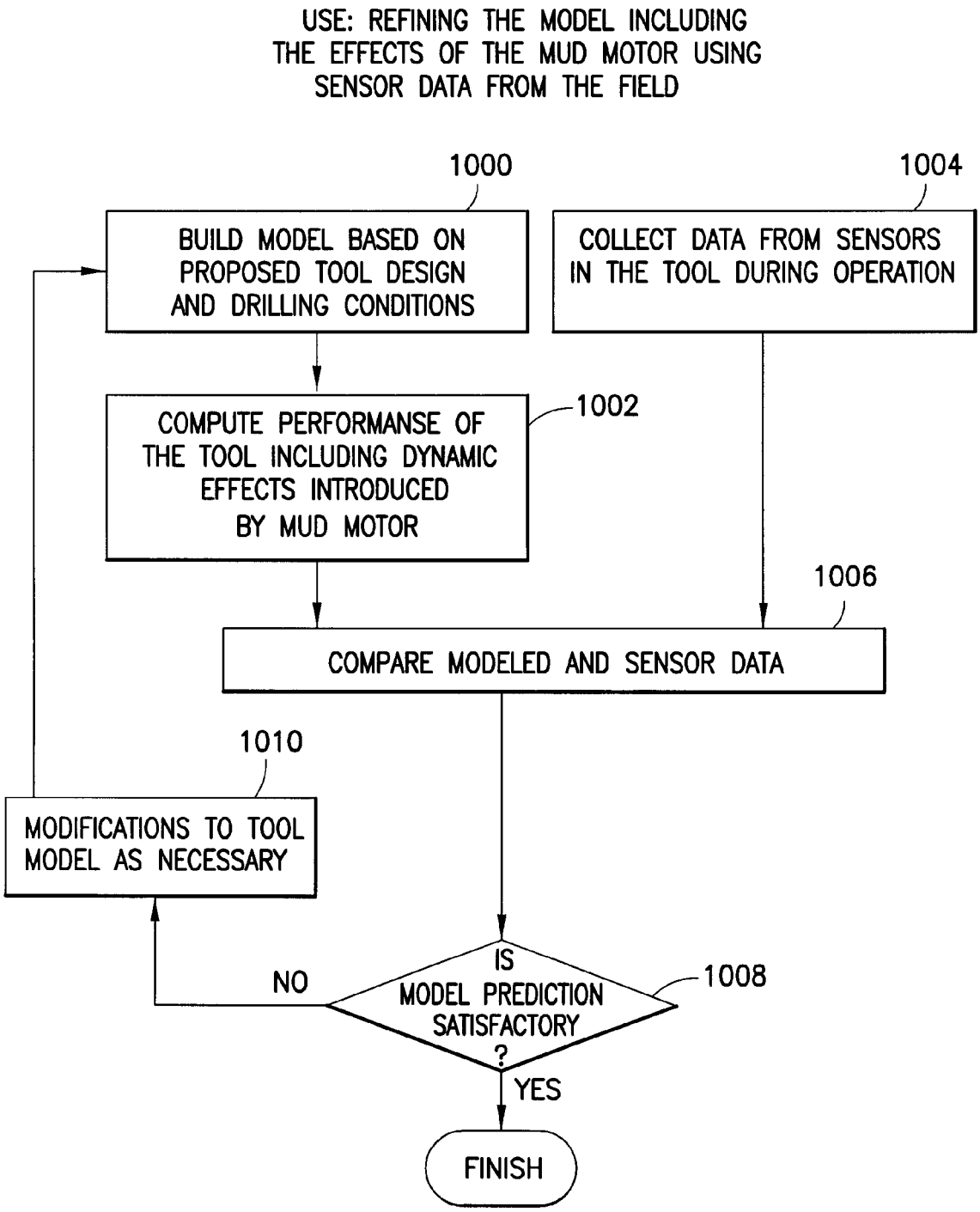
FIG. 10 is a flow diagram of refining the model by including the effects of the mud motor using sensor data from the field.

FIG. 10 illustrates refining the model by including the effects of the mud motor using sensor data from the field. In step (1000) a model is built based on a proposed tool design and drilling conditions. Performance of the tool inclusive of dynamic effects introduced by a mud motor is then computed as indicated by step (1002). Data is collected during operation from sensors in the tool as indicated by step (1004). The modeled data and sensor data are then compared as indicated by step (1006). If the model prediction is not satisfactory, as determined in step (1008), then modification may be made to the model as indicated in step (1010). Otherwise, if model prediction is satisfactory, then the procedure is considered finished.

It should be understood that once a satisfactory response from the model has been found based on known data from an ongoing drilling operation, then the refined model can be used to help find ways to improve the drilling operation as described above (FIG. 9 and paragraph 0047).

Figure 11:
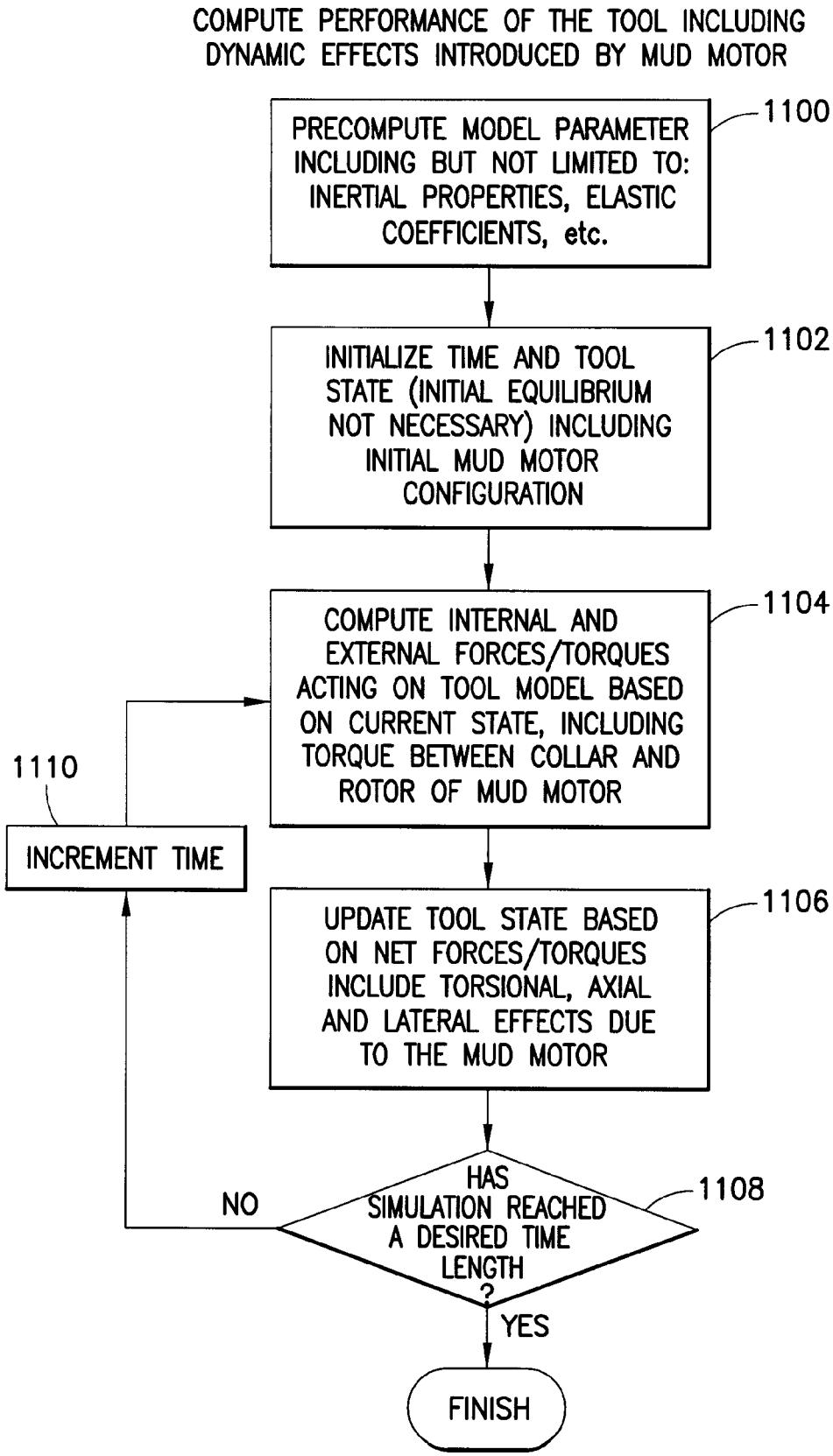
FIG. 11 is a flow diagram of computing performance of the tool by including dynamic effects introduced by mud motor.

FIG. 11 illustrates computing performance of the tool by including dynamic effects introduced by mud motor. In an initial step (1100), model parameters such as inertial properties and elastic coefficients are precomputed. The next step (1102) is to initialize time and tool state. Then, in step (1104), internal and external forces and torques acting on the tool model are computed based on the current state, including the torque between the collar and rotor of the mud motor. Tool state is then updated based on the net forces and torques, including torsional, axial, and lateral effects due to the mud motor, as indicated in step (1106). Unless the simulation has reach a desired duration in terms of time length, as determined in step (1108), the time is incremented in step (1110) and flow returns to step (1104). Otherwise, if the simulation has run for a desired length of time then the procedure is considered finished.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. A method for modeling vibration introduced to a drilling tool by a mud motor, comprising:

specifying a drill string including a plurality of sections of the mud motor wherein the plurality of sections comprise a power section, a transmission section and a bearing section wherein the transmission section mechanically communicates power from the power section to the bearing section;

developing vibration models of the plurality of sections of the mud motor:

computing torsional, axial and lateral vibration effects for the power section;

computing torsional, axial and lateral vibration effects for the bearing section;

computing axial vibration effects for the transmission section;

computing interactions between each of the plurality of sections to produce modeled vibration effects; and controlling an aspect of drilling based at least in part on the modeled vibration effects.

2. The method of claim 1 wherein equipment is run below the mud motor, between the mud motor and a drill bit, and further including modeling an operational environment below the mud motor.

3. The method of claim 1 wherein the bearing section includes a thrust bearing.

4. The method of claim 1 wherein the power section includes a stator and a rotor, and further including computing torsional interaction between the stator and the rotor.

5. The method of claim 4 further including computing lateral excitation of the stator due to nutation of the rotor as it turns.

6. The method of claim 1 further including modeling the drilling tool as a discrete number of segments, each segment individually modeled as a rigid body, wherein adjacent segments are modeled as being connected through a set of springs that constrain relative motion between the segments.

7. The method of claim 6 further including computing spring constants based on local cross sections of the tool, length of the segments, and elastic properties of collar material.

8. Apparatus for enhancing drilling with a drilling tool, comprising:

a mud motor comprising a plurality of sections including a power section, a transmission section and a bearing section wherein the transmission section mechanically communicates power from the power section to the bearing section;

at least one sensor that collects raw vibration data proximate to the mud motor;

a device that operates in response to the vibration data from the at least one sensor to:

model vibrations of the plurality of sections of the mud motor:

compute torsional, axial and lateral vibration effects for the power section;

compute torsional, axial and lateral vibration effects for the bearing section;

compute axial vibration effects for the transmission section; compute interactions between each of the sections to produce modeled vibration effects; and control an aspect of drilling based at least in part on the modeled vibration effects.

9. The apparatus of claim 8 wherein equipment is run below the mud motor, between the mud motor and a drill bit, and wherein the device models an operational environment below the mud motor.

10. The apparatus of claim 8 wherein bearing section includes a thrust bearing.

11. The apparatus of claim 8 wherein the power section includes a stator and a rotor, and the device models torsional interaction between the stator and the rotor.

12. The apparatus of claim 8 wherein the device models lateral excitation of the stator due to nutation of the rotor as it turns using a center of mass position preservation approach.

13. The apparatus of claim 8 wherein the device models the drilling tool as a discrete number of segments, each individually modeled as a rigid body, wherein adjacent segments are modeled as being connected through a set of springs that constrain relative motion between the segments.

14. The apparatus of claim 13 further including computing spring constants based on local cross sections of the tool, length of the segments, and elastic properties of collar material.

15. A computer program product, comprising a non-transitory computer readable medium having computer executable instructions embodied therein, said computer executable instructions when executed by a computer implement a method for modeling vibration effects introduced to a drilling tool by a mud motor, said method comprising:

obtaining data from a drill string including a plurality of sections of the mud motor wherein the plurality of sections comprise a power section, a transmission section and a bearing section wherein the transmission section mechanically communicates power from the power section to the bearing section;

developing vibration models of the plurality of sections of the mud motor:

computing torsional, axial and lateral vibration effects for the power section;

computing torsional, axial and lateral vibration effects for the bearing section;

computing axial vibration effects for the transmission section;

computing interactions between each of the sections to produce modeled vibration effects; and controlling an aspect of drilling based at least in part on the modeled vibration effects.

16. The computer program product of claim 15 where equipment is run below the mud motor, between the mud motor and a drill bit, the method further including modeling an operational environment below the mud motor.

17. The computer program product of claim 15 wherein the bearing section includes a thrust bearing.

18. The computer program product of claim 15 wherein the power section includes a stator and a rotor, and the method further including computing torsional interaction between the stator and the rotor.

19. The computer program product of claim 18, the method further including computing lateral excitation of the stator due to nutation of the rotor as it turns using a center of mass position preservation approach.

20. The computer program product of claim 15, the method further including modeling the drilling tool as a discrete number of segments, each segment individually modeled as a rigid body, wherein adjacent segments are modeled as being connected through a set of springs that constrain relative motion between the segments.

21. The computer program product of claim 20, the method further including computing spring constants based on local cross sections of the tool, length of the segments, and elastic properties of collar material.

* * * * *